US006615815B1

(12) United States Patent
Liang

(10) Patent No.: US 6,615,815 B1
(45) Date of Patent: Sep. 9, 2003

(54) SHOOTING MECHANISM OF AN ANTI-VIOLENCE GUN

(75) Inventor: GuoDong Liang, Jiangmen (TW)

(73) Assignee: Qian Wei Paintball Support Co., Ltd., Guangdong Province (CN)

( * ) Notice: Subject to any disclaimer, the term of this patent is extended or adjusted under 35 U.S.C. 154(b) by 0 days.

(21) Appl. No.: 10/219,335

(22) Filed: Aug. 16, 2002

(51) Int. Cl.[7] ..... F41B 11/00
(52) U.S. Cl. ..... 124/71
(58) Field of Search ..... 124/71, 57; 42/1.14

(56) References Cited

U.S. PATENT DOCUMENTS

| | | | | | |
|---|---|---|---|---|---|
| 2,375,314 | A | * | 5/1945 | Mills | 124/57 |
| 2,660,993 | A | * | 12/1953 | Blakeslee | 124/71 |
| 2,725,048 | A | * | 11/1955 | Koogle | 124/71 |
| 2,767,701 | A | * | 10/1956 | Schwartz et al. | 124/71 |
| 2,923,285 | A | * | 2/1960 | Salles | 124/63 |
| 2,964,031 | A | * | 12/1960 | Dotson | 124/57 |
| 3,142,293 | A | * | 7/1964 | Harter | 124/57 |
| 3,417,719 | A | * | 12/1968 | Nitenson | 114/20.1 |
| 3,630,151 | A | * | 12/1971 | Rakowsky | 102/202 |
| 3,688,765 | A | * | 9/1972 | Gasaway | 604/70 |
| 3,830,214 | A | * | 8/1974 | Curtis | 124/57 |
| 3,999,534 | A | * | 12/1976 | Chapin et al. | 124/74 |
| 4,644,930 | A | * | 2/1987 | Mainhardt | 124/58 |
| 4,843,750 | A | * | 7/1989 | Blase | 42/95 |
| 5,016,536 | A | * | 5/1991 | Brighton | 102/430 |
| 5,230,324 | A | * | 7/1993 | Van Horssen et al. | 124/61 |
| 5,652,405 | A | * | 7/1997 | Rakov | 89/7 |
| 5,706,795 | A | * | 1/1998 | Gerwig | 124/71 |
| 5,791,327 | A | * | 8/1998 | Riggs et al. | 124/71 |
| 5,909,000 | A | * | 6/1999 | Rakov | 89/7 |

* cited by examiner

*Primary Examiner*—Charles T. Jordan
*Assistant Examiner*—Jordan Lofdahl
(74) *Attorney, Agent, or Firm*—Troxell Law Office PLLC

(57) ABSTRACT

A shooting mechanism of an anti-violence gun, more particularly a shooting mechanism shoots spherical bullet body for deterrence through air pressure. The present invention mainly comprises a barrel with a bore connected rearward; a tension spring is disposed inside the bore and expands a shuttle tube which has a high pressured air bottle loaded at the rear aspect thereof. Before using the gun, the shuttle tube is fixed by an insert cotter; after a lift-press plate releases the insert cotter, the air bottle rapidly withdraws toward the rear end of the bore and is punctured by a push needle disposed at a rear end thereof such that the high pressured air inside the high pressured air bottle reversely pushes and presses the spherical body thereby achieving an objective of shooting safely for deterrence.

7 Claims, 1 Drawing Sheet

SHOOTING MECHANISM OF AN ANTI-VIOLENCE GUN

BACKGROUND OF THE INVENTION

Recently, almost any place, no matter it is a public area or transportation, has the possibility to be held up by a hoodlum or terrorist. For repressing such action, it is necessary to use weapons with high destroying power, such as real guns and bullets to deter. However, the damage caused by the deterrence using real guns and bullets is obvious. In a tightly enclosed transportation, such as an airplane, it is necessary to add the air pressure in the cabinet for flying at a high altitude. Therefore, the casing of the airplane must be airtight without any through hole to cause the danger of air pressure leakage. In order to repress the hoodlum's holdup action, it is hard to use weapons with high destroying power or injuring tools for crime prevention. The reason is quite simple. To use the real guns and bullets is threatening since it might directly damage the airplane body or mistakenly shoot the innocent third party. Therefore, some of the security apparatus use rubber bullets with lower killing power for shooting. However, the shooting method thereof uses the same way of utilizing gunpowder or high electric pressure for striking an electric shock which might also cause gunpowder damage; furthermore, the high electric pressure might interfere the radio wave and the aviating navigation.

SUMMARY OF THE INVENTION

Therefore, the primary objective of the present invention is to improve the conventional shooting mechanism by designing an anti-violence gun to work by air pressure method and puncturing one end of a high pressured air bottle to release air pressure for pressing a deterrent and spherical rubber body thereby achieving the objective of shooting safely and deterring effectively.

The secondary objective of the present invention is to dispose a safety lid on part of the outer periphery relevant to an insert cotter switch for eliminating the occurrence of error movement.

The third objective of the present invention is to dispose a rear end plug at the rear end of a bore and opposite a discharge hole for conducting necessary preparation before the shooting so as to achieve the objective of having a second safety guard.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figures 1, 2:
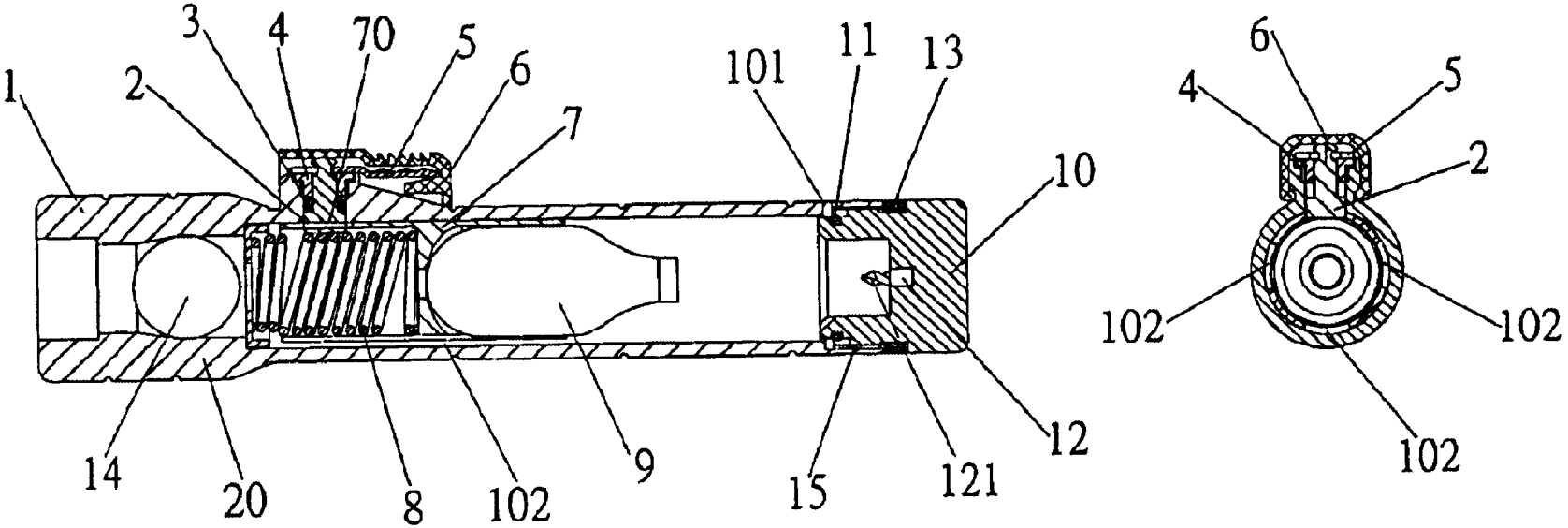
FIG. 1 is a lateral and cross-sectional drawing of the structure of the present invention.
FIG. 2 is a transverse and cross-sectional drawing of part of the mechanism relevant to an insert cotter of the present invention.

Referring to FIGS. 1 and 2, the present invention of a shooting mechanism of an anti-violence gun, more particularly a shooting mechanism provided for shooting deterrent spherical body through high pressured air to be applied suitably at an extremely dangerous site for achieving a safely designed deterrent effect. The present invention mainly comprises a barrel (1) with a bore (20) connected rearward; the interior of the barrel (1) is pre-disposed with a rubber-made spherical body for deterrence (14). A tension spring (8) is disposed inside the bore (20) through a shuttle tube (7); one end of the tension spring (8) pushes closely to the front end of the barrel (1) and the rear end thereof expands to press the shuttle tube (7). A high pressured air bottle (9) is loaded at the rear aspect of the shuttle tube (7) which is fixedly clamped or released by an insert cotter (2). However, after being released, the entire body of the air-.bottle (9) rapidly withdraws rearward and is punctured by a push needle (12) thereby fast shooting the high pressured air at the bottom portion of the air bottle (9) outwardly so as to forcefully press the spherical body (14) to shoot toward the direction of the barrel (1).

The position of the barrel (1) near the bore (20) is provided for placing the spherical body for deterrence (14). The entire body of the interior portion of the barrel (20) is formed as a circular tube shape with the shuttle tube (7) disposed therein to slide back and forth. The tension spring (8) expands the shuttle tube (7); the other end of the tension spring (8) pushes the position closed to the barrel (1). The lateral side of the shuttle tube (7) is disposed with an insert hole (70) for inserting the insert cotter (2) which is fixedly lifted upwardly by a lever lift-press plate (5); the lift-press plate (5) is fixedly retained by a safety lid (6); the interior of the safety lid (6) is formed to be able to lift the lever lift-press plate (5) for positioning.

The air bottle (9) is loaded at the rear end of the shuttle tube (7); the rear end of the bore (20) is disposed with a rear end plug (10); the push needle (12) is disposed at the center inside the rear end plug (10); a stop discharge ring (11) is disposed toward the front end opening thereof. A discharge hole (101) is disposed at the position opposite the stop discharge ring (11) in the bore (20). The rear end plug (10) and the bore (20) screw together through a screw portion (15) and are positioned in displacement through a resilient expander (13).

To conduct a shooting action, first the safety lid (6) is removed, as shown in FIG. 2, to expose the lever lift-press plate (5). Depressing a free end thereof lifts the insert cotter (2) upwardly and that is regarded as it separates from the insert hole (70) disposed on the shuttle tube-(7). Therefore, the shuttle tube (7) is in a free state and pushed by the tension spring (8) to rapidly withdraw rearward with the air bottle (9) loaded at the rear end thereof The opening of the air bottle (9) faces toward and is punctured by the push needle (12) of the rear end plug (10). The push needle (12) is disposed with a spiral groove (121); after the air bottle (9) is punctured, the high pressured air inside the air bottle (9) shoots outwardly via the spiral groove (121) to reversely pass toward and shoot the spherical body for deterrence (14) through a guide slot (102). When the high pressured air is generated by the air bottle (9), the relevant position of the insert cotter (2) uses the stop discharge ring (3) to block the discharge. The insert cotter (2) is longitudinally positioned through a sleeve It is necessary to form the rear end portion of the rear end plug (10) as an enclosed state if the .rear end plug (10) is screwed in through the screw portion (14); therefore, the position of the stop discharge ring (11) is located beyond the position of the left end of the discharge hole (101) to make the discharge hole (101) locate at the right end of the stop discharge ring (11) and the rear end portion of the bore (20) form a sealed state. If the rear end plug (10) moves the stop discharge ring (11) rearward over the right end position of, the discharge hole (101) and if the operation caused by an error movement punctures the air bottle (9), the shot pressure discharges directly through the discharge hole (101) without generating a shooting pressure force toward the spherical body for deterrence (14). Therefore the rear end plug (10) works as the second safety guard.

The rear end plug (10) is capable of withdrawing completely. When moving away from the bore (20), it supplements the spherical body for deterrence (14) and the air bottle (9). The supplement method is to entirely withdraw and unload the shuttle tube (7) and the tension spring (8) disposed inside the shooting mechanism set; first the spherical body for deterrence (14) is placed therein; then a shuttle tube (7) loaded with a brand-new air bottle (9) and the spring (8) are placed therein. The air bottle (9) is pushed to further push the shuttle tube (7) toward the barrel (1) until the insert hole (70) disposed on the shuttle tube (7) is again penetrated and retained by the insert cotter (2) so as to finish the leading preparation before using the gun.

In summation of the abovementioned, the primary objective achieved by the present invention is applied to the shooting method of the anti-violence gun through using the pressing force generated by the high pressured air to shoot the spherical body for deterrence. Using the high pressured air is a way of expanding safely and facilitating the application in an extremely dangerous environment, such as an oil refinery, a gas station, a steamship, a transportation or an airplane, for obtaining an effective and safe anti-violence design to deal with the hoodlums. Basically, using the expansion of the high pressure air obviously indicates the safety of the shooting and that makes the present invention provide an innovative and safe application effect in the application scope of anti-violence.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A shooting mechanism of an anti-violence gun comprising:

a) a barrel having a first barrel end and a second barrel end, the barrel having a bore from the first barrel end to the second barrel end;

b) a shuttle tube for holding a high pressure air bottle, the shuttle tube having an insert hole and being slidably located within the bore of the barrel;

c) a spring inserted into the shuttle tube;

d) a rear plug having a push needle and being threadably connected to the second barrel end;

e) a first safety and firing device having a safety lid and a lever lift-press plate connected to an insert cotter, wherein the lever lift-press plate is movable between a safety position and a firing position such that:

(i) in the safety position the insert cotter engages the insert hole of the shuttle tube and holds the shuttle tube in a pressed position against the spring, and the safety lid being connected to and covering the lever lift-press plate; and (ii) in the firing position the safety lid is removed from the lever lift-press plate, the lever lift-press plate is pressed to disengage the insert cotter from the insert hole thereby releasing the shuttle tube, whereby the spring moves the shuttle tube and the high pressure air bottle toward the push needle of the rear plug such that the high pressure air bottle is punctured by the push needle; and f) a second safety device having an open and a closed position, such that in the open position the contents of the high pressure air bottle that has been punctured are released through the second safety device and in the closed position the contents of the high pressure air bottle that has been punctured are released through the first barrel end.

2. The shooting mechanism of an anti-violence gun according to claim 1, wherein the second safety device includes a discharge hole in the barrel at the second barrel end and a stop discharge ring located on the rear plug, such that in the open position the discharge hole is open to the bore and in the closed position the stop discharge ring is positioned between the discharge ring and the bore.

3. The shooting mechanism of an anti-violence gun according to claim 1, wherein an external surface of the push needle has a spiral groove.

4. The shooting mechanism of an anti-violence gun according to claim 1, wherein the shuttle tube is removable from the second barrel end.

5. The shooting mechanism of an anti-violence gun according to claim 1, wherein the bore has an air pressure guide slot.

6. The shooting mechanism of an anti-violence gun according to claim 1, wherein the rear plug has a resilient expander.

7. The shooting mechanism of an anti-violence gun according to claim 1, wherein a spherical rubber body is propelled under pressure from the bore at the first barrel end.

* * * * *